US007908891B2

(12) United States Patent
Thompson et al.

(10) Patent No.: US 7,908,891 B2
(45) **Date of Patent: *Mar. 22, 2011**

(54) KNITTED GLOVE

(75) Inventors: Eric Thompson, Central, SC (US); Gerardo Rodriguez Garay, Juarez (MX)

(73) Assignee: Ansell Healthcare Products LLC, Red Bank, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/430,048

(22) Filed: Apr. 24, 2009

(65) Prior Publication Data

US 2009/0211305 A1 Aug. 27, 2009

Related U.S. Application Data

(63) Continuation-in-part of application No. 12/209,529, filed on Sep. 12, 2008, now Pat. No. 7,555,921, which is a continuation-in-part of application No. 11/444,806, filed on Jun. 1, 2006, now Pat. No. 7,434,422, which is a continuation-in-part of application No. 11/181,064, filed on Jul. 13, 2005, now Pat. No. 7,213,419, which is a continuation-in-part of application No. 10/892,763, filed on Jul. 16, 2004, now Pat. No. 6,962,064.

(51) Int. Cl.
*D04B 9/58* (2006.01)

(52) U.S. Cl. ..... 66/174

(58) Field of Classification Search ..... 66/174, 66/161.1, 161.6, 159, 202, 158; 2/158–163
See application file for complete search history.

(56) References Cited

U.S. PATENT DOCUMENTS

| | | | | |
|---|---|---|---|---|
| 5,187,815 | A | 2/1993 | Stern et al. | |
| 5,231,700 | A | 8/1993 | Cutshall | |
| 5,239,846 | A * | 8/1993 | Kitaura et al. | 66/174 |
| 5,284,032 | A | 2/1994 | Shima | |
| 5,511,394 | A | 4/1996 | Shima | |
| 5,547,733 | A | 8/1996 | Rock et al. | |
| 5,564,127 | A | 10/1996 | Manne | |
| 5,965,223 | A | 10/1999 | Andrews et al. | |
| 6,044,493 | A | 4/2000 | Post | |
| 6,155,084 | A | 12/2000 | Andrews et al. | |
| 6,182,477 | B1 | 2/2001 | Shibata et al. | |

(Continued)

FOREIGN PATENT DOCUMENTS

| | | |
|---|---|---|
| JP | 57-106753 | 7/1982 |

(Continued)

*Primary Examiner* — Danny Worrell
(74) *Attorney, Agent, or Firm* — Moser IP Law Group

(57) ABSTRACT

A knitted glove made by creating each of the sections of the glove using a separate knitting course on a flat knitting machine providing variable stitch dimensions. Each of these sections provides its own designed stretch characteristics so that the glove fits tightly, yet provides flexibility and ease of movement. The variable stitch dimension is achieved by 1) varying the depth of penetration of a knitting needle into a fabric being knitted by a computer program, 2) adjusting the tension of yarn between a pinch roller and a knitting head by a mechanism controlled by a computer, and 3) casting off or picking up additional stitches in a course. The glove includes a plurality of finger components made from at least ten separately knitted sections, two palm components, each of which is made from at least two separately knitted sections, and a wrist component made from at least one knitted section.

20 Claims, 5 Drawing Sheets

U.S. PATENT DOCUMENTS

| | | | |
|---|---|---|---|
| 6,550,285 | B2 | 4/2003 | Nishitani |
| 6,581,366 | B1 | 6/2003 | Andrews |
| 6,766,635 | B2 | 7/2004 | Andrews |
| 6,782,720 | B2 | 8/2004 | Vero et al. |
| 6,782,721 | B1 | 8/2004 | Vero et al. |
| 6,790,122 | B2 | 9/2004 | Mitchell et al. |
| 6,823,699 | B1 | 11/2004 | Vero et al. |
| 6,962,064 | B1 | 11/2004 | Hardee et al. |
| 6,945,080 | B2 | 9/2005 | Maeda et al. |
| 6,962,864 | B1 | 11/2005 | Jeng et al. |
| 7,213,419 | B2 | 5/2007 | Hardee et al. |
| 7,246,509 | B2 | 7/2007 | Hardee et al. |
| 7,434,422 | B2 | 10/2008 | Thompson et al. |
| 7,555,921 | B2 | 7/2009 | Thompson et al. |
| 2004/0055070 | A1 | 3/2004 | Maeda et al. |

FOREIGN PATENT DOCUMENTS

| | | |
|---|---|---|
| JP | 11-200123 | 7/1999 |
| JP | 2002-201515 | 7/2002 |
| JP | 2005-038116 | 2/2005 |
| WO | WO-00/67600 | 11/2000 |

* cited by examiner

KNITTED GLOVE

CROSS-REFERENCE TO RELATED APPLICATIONS

This application claims continuation-in-part priority to U.S. Ser. No. 12/209,529 filed on Sept. 12, 2008, now U.S. Pat. No. 7,555,921, which claims continuation-in-part priority to U.S. Ser. No. 11/444,806 filed on Jun. 1, 2006, now U.S. Pat. No. 7,434,422, which claims continuation-in-part priority to U.S. Ser. No. 11/181,064, filed Jul. 13, 2005, now U.S. Pat. No. 7,213,419, which is a continuation-in-part of application Ser. No. 10/892,763, filed Jul. 16, 2004, now U.S. Pat. No. 6,962,064, the disclosures of which are hereby incorporated by reference in their entireties.

The present invention relates to knitted gloves. More specifically, the invention relates to knitted gloves, knitted glove liners, and methods of making them.

TECHNICAL FIELD

The present invention relates to knitted gloves. More specifically; the invention relates to knitted gloves, knitted glove liners, and methods of making them.

BACKGROUND

Knitted gloves are commonly used in handling and light assembly conditions. Knitted gloves used for these purposes are currently made using flat knitting machines that use a number of needles in the form of a needle array and a single yarn to knit the gloves using eight basic components to comprise the glove. These eight components include one component for each of the five fingers, two components for the palm including an upper section and a lower section, and one component for the wrist area. All of these sections are cylinders or conical sections that join to each other fashioning the general anatomical shape of a hand. Conventional knitting processes use a knitting machine to knit each of these areas in a particular sequence, generally one finger at a time, beginning with the pinky finger and continuing on through the ring finger and middle finger to the forefinger. After each finger is knitted using only selected needles in the needle array, the knitting process for this finger is stopped, and yarn is cut and bound. The knitted finger is held by holders, weighted down by sinkers. The next finger is knit sequentially one at a time using a different set of needles in the needle array. When all four fingers are knitted in this fashion, the knitting machine then knits the upper section of the palm, picking stitches from each of the previously knit four fingers. The method of knitting individual fingers and picking stitches to knit the upper palm section with crotches that are well-fitted is discussed in U.S. Pat. App. Pub. No. 2004/0055070 by Maeda et al. After knitting an appropriate length of upper palm, the thumb portion is initiated, using a separate set of needles in the needle array, and the lower section of the palm is knit using all of the needles in the needle array. Finally, the knitting machine knits the wrist component to the desired length.

The knitting stitches used at the fingertips are generally tighter than the stitches used elsewhere in the glove to improve the strength of the glove in this area, where more pressure is likely to be applied. Depending on the size of the needles used and the denier of the yarn to knit the gloves, a certain number of courses are used to create each of the eight components of the glove. The finer the gauge of needle used, the higher the number of courses for each component to create the same size of a finished glove. Changing needles or the denier of a yarn is extremely difficult in a continuous process and generally a continuous yarn of pre-selected denier and a corresponding needle size are commercially used. While this standardization in needle size and number of courses permits the manufacturing of a glove or liner with a standard shape, that shape does not accommodate variations in size and shape of individual fingers and hands.

U.S. Pat. No. 6,155,084 to Andrews et al. discloses protective articles made of a composite fabric. These protective articles provide an unprecedented level of safety and comfort and are made of two or more dissimilar yarns including thermoplastics, elastomers, or metals, each having dissimilar mechanical properties and characteristics. Thus, the protective article does not use a heavy weight fabric in regions of the article where exceptional protection is not critical and avoids the accompanying loss of tactile sensitivity. The protective article uses dissimilar fibers at selected protective fabric locations and does not aim to conform to the anatomical shape of a hand using a single yarn.

U.S. Pat. No. 6,550,285 to Nishitani discloses a yarn feeding apparatus. This apparatus minimizes fluctuation in tension of a knitting yarn, and an accurate length of the knitting yarn is fed, even if the amount of demand for the knitting yarn is suddenly changed. A knitting yarn is interposed between a main roller and a driven roller with yarn storage having a buffer rod, the inclination of which controls the storage. An angle sensor detects this angular inclination and uses a PID algorithm to predict the amount of knitting yarn demanded. The PID algorithm controls a servo-motor that drives the driven roller, such that the tip portion of the buffer rod is brought to its original position at the start of knitting. This device minimizes the fluctuations in knitting yarn tension due to sudden demand and is not programmed to alter the knitting yarn tension to adjust stitch dimensions.

U.S. Pat. No. 5,284,032 to Shima discloses a stitch control mechanism for a flat knitting machine. A stitch control mechanism is applicable for a flat knitting machine and controls loop size in a knit fabric. A spiral cam plate is attached to one surface of a stitch control cam. The spiral cam plate is held between a pair of cam rollers, and the pair of cam rollers is supported on a guide plate. The stitch cam has a portion slidably fitted in a guide slot formed in a base plate. The stitch dimension or loop size is controlled by the stitch control cam and can be changed by a computer program. This patent discloses the hardware necessary for stitch dimension control and does not disclose a knitted glove or liner with anatomic features providing improved fit.

Standard shaped gloves or liners created by the current processes bring with them several disadvantages. First, the fit across finger knuckles and the center of the palm is tight, reducing glove or liner flexibility and ultimately reducing hand dexterity. Second, the standard gloves or liners bag or gap in areas where the hand normally tapers, e.g., like the lower palm and wrist area. This bagginess or gapping results in excess fabric, which can bunch and catch on protruding objects. Additionally, excess fabric at the lower palm created by the standard glove or liner shape causes an irregular foam line on those liners that are dipped in latex. Finally, the excess fabric at the lower palm of the standard glove or liner causes a high scrap rate in printing information on the gloves or liners.

In an attempt to solve these problems, knit gloves or liners can be made of a larger than standard size to shrink them to achieve a better fit. These larger gloves are reduced in size by tumbling them in heat or using a laundry process. These processes as used on the larger gloves, however, may produce gloves that have improved fit across the knuckles, but do not address the excess fabric in areas where the hand normally tapers, like the lower palm and wrist, since the shrinkage is uniform across the glove. Additionally, tumbling or a laundry process would require an additional manufacturing step as well as additional labor, both of which would increase the cost of the finished product. A standard tumbling process, using constant heat and time, would also fail to create the desired gloves and liners because of differences in heat sensitivity of the fibers selected to knit the various gloves and liners in a manufacturing operation. Further, these types of post-knitting processes would require additional development and manufacturing time to determine appropriate time and heat combinations to optimize the production of a particular glove or liner.

A glove that could be made to fit the contours of a human hand better to improve grip and that would not require post-knitting processing would, therefore, be an important improvement in the art. The present invention seeks to provide such a glove. This and other objects and advantages, as well as additional inventive features, will be provided by the detailed description provided herein.

SUMMARY

The present invention is directed towards knitted gloves and liners and a method of making these knitted gloves and liners using a continuous single yarn and array of knitting needles matching the yarn denier. The invention relates to the fit of knitted gloves or liners on a human hand. Specifically, the stitch dimension and the number of courses used to knit each of the standard eight major glove components and their sections of the glove are altered to provide a glove geometry, which is anatomically matched to a human hand, providing increased stretch capability in areas that flex during movement. This increased stretch capability provides the wearer with a tight-fitting glove, which still provides a comfortable glove feel and an easy movement capability. These geometric alterations help conform the glove or liner to better fit human hands. The alterations permit manufacturing of gloves or liners with nearly perfect fit to the hand because of their tapered fingertips, expanded knuckles, tapered palm areas and expanded cuff width.

The stitch dimension in each course that is knitted determines the level of stretch available at that knitted course location. The number of courses determines the overall stretch of the fabric at a particular location in the glove. The stitch dimension has three discrete components, which may be changed individually or changed in combination under computer control of the flat knitting machine. The first embodiment of the stitch dimension comprises stitch setup specification, which increases or decreases the depth of penetration of the knitting needle into the knitted fabric. Increasing the depth of penetration of the knitted needle brings in a larger length of knitting yarn in the knitted loop, and the stitch can expand more than stitches knitted with smaller depth of penetration. If a full course is knitted with a deeper depth of penetration, that course can stretch more readily. If subsequent courses are knitted with the same depth of penetration, the fabric knitted has a uniform stretch feel. However, if the depth of penetration of the knitting needle is progressively decreased, the fabric knitted has a stretch feel that decreases progressively. Therefore, the depth of penetration of the knitting needle provides a knitted fabric section of a glove that has 'designed in' stretch capability.

In a second embodiment of the stitch dimension, the tension in the yarn that is being knitted is increased or decreased under computer control. The yarn from a spool is clamped between a pair of pinch rollers, one of which may optionally be a computer-controlled feeding roller. Due to the pinching action, the tension in the yarn in the knitting head is not transmitted to the yarn spool. The computer controls the tension in the yarn in the segment between the pinch roller and the knitting head by means of a computer-controlled tension adjustment mechanism. This adjustment mechanism may comprise a spiral spring carrying an arm through which the yarn passes. A spiral spring is attached to the arm, and the other end of the spiral spring is attached to a stepper motor. The computer rotates the stepper motor shaft, thereby increasing or decreasing the tension in the yarn in the segment between the pinch roller and the knitting head. The tension in the knit stitch limits its stretch capability. A full course stitched with increased tension has reduced stretch capability of that course. Accordingly, a fabric knitted with a number of courses with increased tension exhibits reduced stretch capability.

In a third embodiment of stitch dimension, a stitch can be missed in knitting a course. This decreases the overall stretch capability of the course. On the other hand, an additional stitch can be picked from the stitch to increase the overall length of a course to provide increased stretch capability.

In one embodiment, the glove has eight components, four of which define the four fingers, two of which define the palm, one defining the thumb and one defining the wrist. In a further embodiment, the palm comprises three components, thereby providing a glove having nine components. Each of these components is divided into one or more sections. In one embodiment, one or more of the finger components of the glove is divided into two or more sections. The upper and lower palm components are divided into two or more sections, and the wrist component is made up of one or more sections, where each section is knitted using a different stitch setup and each of the stitch setups is continued for a number of courses according to the desired geometrical shape of the glove. In another embodiment, each finger component of the glove is divided into three sections, and the upper and lower palm of the glove is divided into three sections, where each section is knitted using a different stitch setup and each of the stitch setups is continued for a number of courses according to the desired geometrical shape of the glove. In another embodiment, the upper and lower palm of the glove is divided into four sections, where each section is knitted using a different stitch setup and each of the stitch setups is continued for a number of courses.

The course knitted with a different stitch dimension essentially provides more yarn or less yarn at a given glove location, thereby providing enhanced or reduced stretch capability. The sections, which are required to have less stretch and, therefore, have a tight feel, are made with stitches that incorporate a smaller length of yarn and/or a high tension or have one or more stitches less than the adjacent courses. Conversely, when a section requires increased stretch capability, the stitches are made with increased yarn length and/or with reduced tension or may have one or more stitches picked up in the courses compared to adjacent courses.

The invention also includes a method for manufacturing gloves and liners using variable stitch dimensions and numbers of courses in each of the sections within each of the eight major glove components to create a better fitting glove.

DETAILED DESCRIPTION

Figure 1:
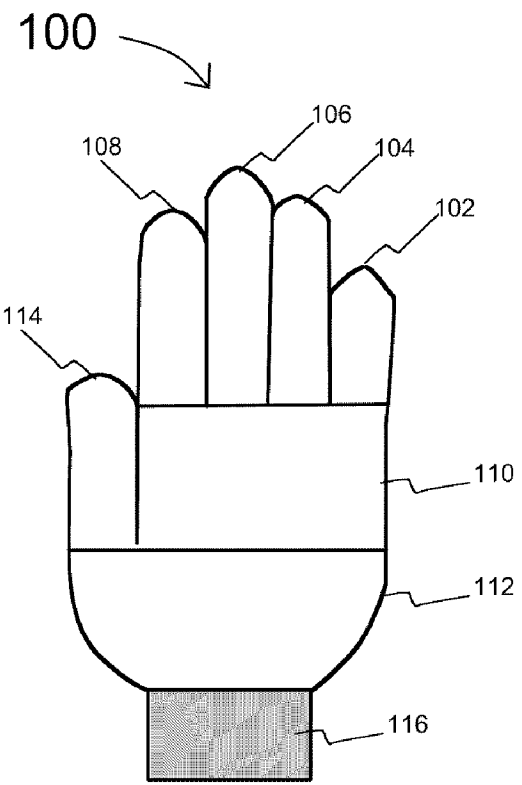
PRIOR ART FIG. 1
FIG. 1 shows a prior art glove knitted using a standard number of courses and needles to create the standard eight components.

The prior art, as shown in FIG. 1, is a glove 100, having eight major glove components. These components include a pinky finger component 102, a ring finger component 104, a middle finger component 106, a forefinger component 108, an upper palm component 110, a lower palm component 112, a thumb component 114, and a wrist component 116. As can be seen in FIG. 1, the shapes of the glove 100 fingers do not taper, nor does the wrist component 116 taper to prevent bagginess and gapping at the wrist. Additionally, the fingers of the glove 100 do not taper near the fingertips.

Existing flat knitting machines can be programmed to accommodate a large number of changes in stitch dimensions using stitch setup and to alter the physical dimensions used in a standard eight component glove 100 of FIG. 1. Stitch setup can be used to "customize" gloves and liners manufactured in sizes 6, 7, 8, 9, and 10. They also can be used to develop specifications for finger length and width, palm length and width, and overall glove or liner length and width.

Figure 2:
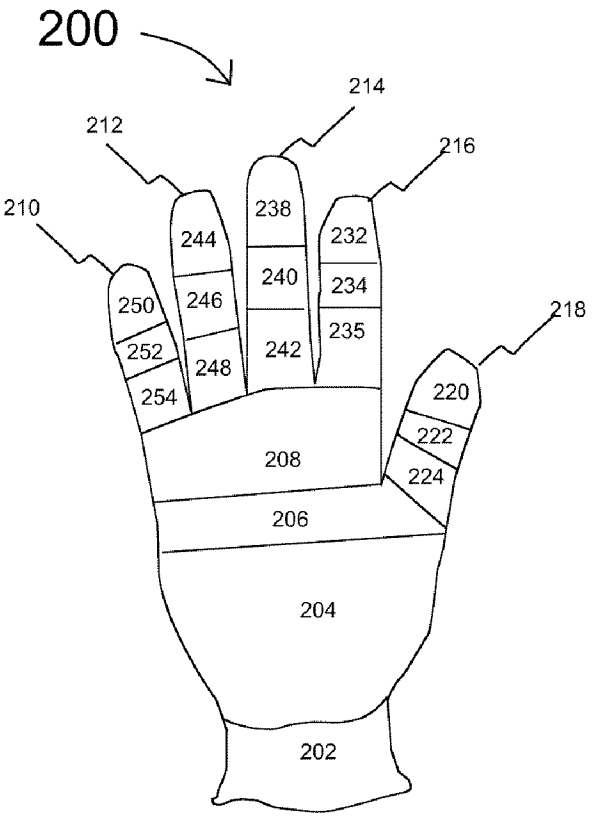
FIG. 2 shows a glove according to an embodiment of the present invention.

FIG. 2 shows a glove 200 according to one embodiment of the present invention. This glove 200 includes nineteen total sections of the glove, including three sections for each of the finger components 210, 212, 214, and 216 and thumb 218 of the glove, three palm sections 204, 206, and 208 and one wrist section 202. Each of the fingers 210, 212, 214, 216 and 218 is knit according to three separate instructions for the knitting machine to create these three distinct areas designed to conform to the shape of fingers. These three sections are shown in FIG. 2 as sections 250, 252, and 254 for the pinky finger 210; sections 244, 246, and 248 for the ring finger 212; sections 238, 240 and 242 for the middle finger 214; sections 232, 234, and 235 for the forefinger 216; and sections 220, 222, and 224 for the thumb 218.

The glove 200 of this invention can be knit on a knitting machine and requires programming of the machine for each of the nineteen sections. For example, the glove 200 can be made according to the specifications provided in Table 1. Each of the components is indicated, and the sections that match FIG. 2 are shown. Note that the courses begin with 1 for each component and continue through the sections. The stitch setup here shows a number, which indicates how deep the knitting needle penetrates. A lower number indicates less needle penetration, while a larger number indicates that the needle penetrates deeper. For example, in component 1, which is the pinky finger, the first course has a knitting needle penetration depth of 37 in course 1 and increases gradually in a linear fashion to a knitting needle penetration depth of 39 at course 39. This means that course 1 is tighter to stretch than course 22, and the pinky finger is draped by the glove with the finger edge tight against the glove. The second section of component 1 continues seamlessly with the same stitch setup of 39, maintaining the depth of penetration of the knitting needle.

TABLE 1

| COMPONENT | STITCH SETUP | COURSES | SECTION IN FIG. 2 |
|---|---|---|---|
| 1 | 37-39 | 1-22 | 250 |
| | 39 | 23-58 | 252 |
| | 39-37 | 59-88 | 254 |
| 2 | 37-39 | 1-32 | 244 |
| | 39 | 33-72 | 246 |
| | 39-37 | 73-116 | 248 |
| 3 | 37-39 | 1-32 | 238 |
| | 39 | 33-72 | 240 |
| | 39-37 | 73-126 | 242 |
| 4 | 37-39 | 1-32 | 232 |
| | 39 | 33-72 | 234 |
| | 39-37 | 73-116 | 235 |
| 5 | 37 | 1-56 | 208 |
| 6 | 37-39 | 1-32 | 220 |
| | 39 | 33-64 | 222 |
| | 39-37 | 65-100 | 224 |
| 7 | 37 | 1-20 | 206 |
| | 36-22 | 21-70 | 204 |
| 8 | 37 | 1-72 | 202 |

This specification in Table 1 can be used on a SFG knitting machine available from Shima Seiki Mfg., Ltd. based in Wakayama, Japan to create a size 9 glove. The information for the stitch setup and the number of courses are entered into the knitting machine's operation system using a keypad and LED display. Adjustments can be made to the specifications in Table 1 to create gloves of different sizes. The gloves can be knit from different compositions of yarn, including cotton, nylon fibers, water-soluble fibers, such as polyvinyl alcohol, or other fibers that can be used on a knitting machine, such as polyester or high-strength synthetic fibers, such as aramid, polyethylene, and liquid crystal polymer. The yarns used to knit the gloves can be spun yarns, textured filament yarns, or multi-component composite yarns.

Figure 3B:
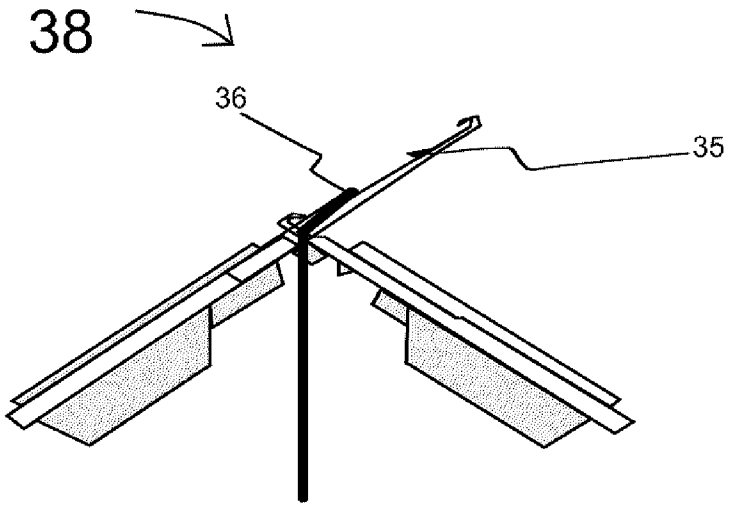
FIGS. 3*a* and 3*b* illustrate an embodiment of varying stitch dimension using a stitch setup wherein the needle penetration determines the length of yarn included in the stitch.
Figure 3A:
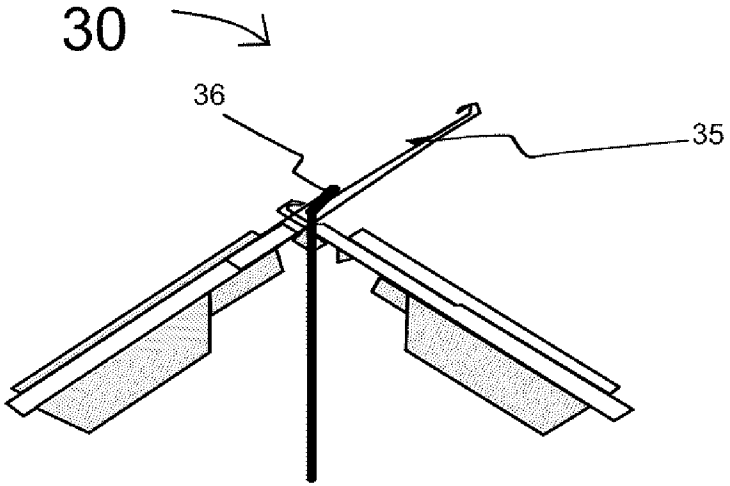

FIG. 3*a* illustrates at 30 a stitch knitted with a smaller stitch setup number. The knitting needle 35 penetrates to a smaller extent, including a smaller loop of yarn 36 in the stitch, providing limited stretch capability.

FIG. 3*b* illustrates at 38 a stitch knitted with a larger stitch setup number. The knitting needle 35 penetrates to a larger extent, including a larger loop of yarn 36 in the stitch, providing enhanced stretch capability.

Figure 4:
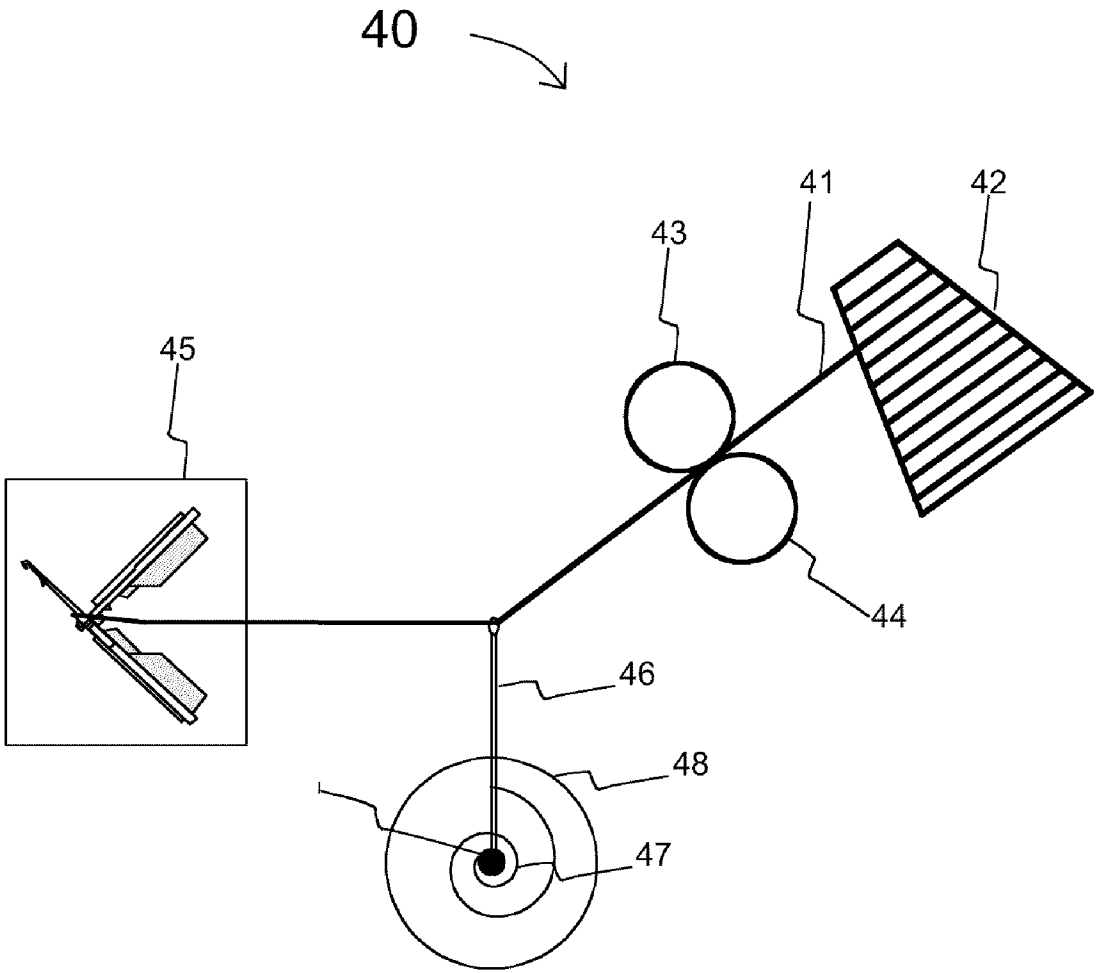
FIG. 4 shows an embodiment of the stitch dimension wherein the computer controls the yarn feeding roller and the tension in the yarn between the pinch roller and the knitting head.

FIG. 4 illustrates at 40 a yarn 41 from a conical spool 42 fed through a pinch roller 43 and yarn feed roller 44. The yarn 41 is supplied to the knitting head 45 through a tension control device comprising an arm 46 attached to a spiral spring 47 which is connected to a computer controlled stepper motor 48. The rotation of the stepper motor shaft 49 increases the tension provided by the spiral spring 47, enhancing the tension in the yarn in the segment between the pinch roller 43 and knitting head 45. This variation in tension, generated under computer control, incorporates a higher level of tension within the stitch, limiting its stretch capability. The dimension of the stitch is independently controlled by the feed roller 44, which is also controlled by the computer.

The knitted variable stitch dimensions in the glove 200 allow the alteration of stitch dimension within a larger number of finger and palm sections than would be found in a standard glove 100. This increased number of sections benefits the glove by improving the degree to which it conforms to the shape of the hand, creating a better fit. In turn, this better fit provides increased dexterity and grip as well as increased long-term comfort in wearing the glove. In the present invention, stitch dimensions can be increased in areas such as knuckles, which would require greater glove flexibility as fingers move.

Knitted stitch dimensions can be used to eliminate additional manufacturing steps that would be required in, for example, the use of heat or water to shrink gloves or liners to fit a particular hand size. This saves both money and time in the manufacturing process and does not require unique times, temperatures, or pressures. It also produces a more consistent product than one relying on difficult-to-control steps, such as heat or tumbling.

A small study has been conducted to compare glove flexibility and resulting hand dexterity of standard shaped gloves as compared to gloves of this invention. Subjects in the study assembled eight sets of five different nut and screw sizes, while wearing the standard glove and while wearing the knitted variable stitch glove of this invention. Each subject in the study showed a decrease in the time it took to assemble the set of nuts and screws when wearing the gloves of this invention. In the study, decreases in time ranged from 13.9% to 20.3%. This study shows that the glove of this invention improved the fit of the knitted gloves, such that it increased dexterity and grip over the standard glove.

The knitted gloves of this invention, once finished, also can be coated either on the outside or inside with a coating, such as natural rubber latex or synthetic rubber latex, as well as other elastomeric polymer coatings. The coating can be applied by dipping the knitted glove of this invention into the coating material or by spraying the coating onto the glove. Coating the knitted gloves of this invention can improve the grip of the glove in handling dry and oily items when the coating is on the outside of the glove. The addition of a coating to the knitted layer can also improve the quality of the glove as an insulator.

Figure 5:
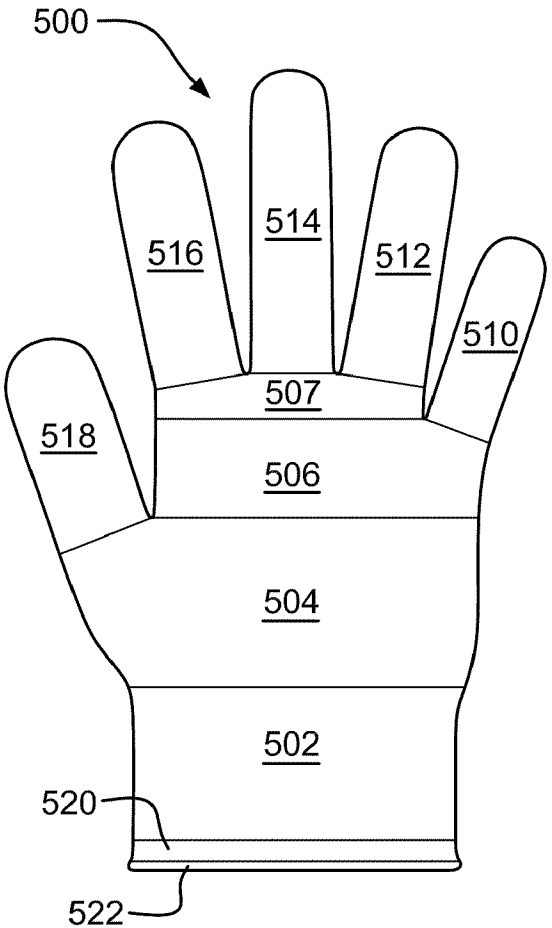
FIG. 5 shows a glove according to an embodiment of the present invention having nine components.

FIG. 5 shows a glove 500 according to one embodiment of the present invention. This glove 500 includes nine components, including each of the finger components 510, 512, 514, and 516, the thumb component 518, three palm components 504, 506, and 507, and the wrist component 502. Palm component 507 is referred to as a three-fingered palm since it is attached to only three finger components 512, 514, and 516 (ring, middle, and first). The presence of palm component 507 permits an ergonomic enhancement to the glove by creating a pinky 510 component that is dropped (that is, a "dropped pinky") as compared to the rest of the fingers. Palm component 506 is a four-fingered palm since it attaches to the pinky 510 and the three-fingered palm component 507. The wrist component contains courses of a colored yarn 520, whose color is chosen to be indicative of the glove size. The wrist component also has a ravel-resistant edge 522.

Glove 500 can be knit on a programmable knitting machine to create gloves having variable stitch to achieve an overall shape that accommodates variations in size and shape of individual fingers and hands. These gloves also have zones that are enhanced with different stitch sizes to permit stretch in the areas of the knuckles, which are called high stress zones. Glove 500 can be made, for example, on a SFG knitting machine available from Shima Seiki Mfg., Ltd. based in Wakayama, Japan, where information for stitch setup and number of courses is entered into the knitting machine's operation system using a keypad and LED display. One main body yarn is used with the addition of a colored yarn at the end of the wrist and a heat fusible yarn subsequent to the colored yarn that prevents unraveling. Each of the components of FIG. 5 is formed from courses having a designated stitch setup. A plurality of courses creates a section within the component. The stitch setup indicates how deep the knitting needle penetrates, which in turn creates a desired size of stitch. A lower number indicates less needle penetration and a tighter stitch, while a larger number indicates that the needle penetrates deeper and creates a looser stitch. For example, to knit component 510, which is the pinky finger, a first set of courses has a knitting needle penetration depth set at a basic value, which could be a fixed value in the range of 25-35, a second set of courses immediately following the first set has a knitting needle penetration depth set at a smaller value than the basic value, which could be a fixed value in the range of 15-24, and a third set of courses immediately following the second set has a knitting needle penetration depth set at a larger value than the basic value, which could be a fixed value in the range of 36-45. This means that the second set of courses are more tightly knit than the first set of courses, which in turn are tighter than the third set of courses. Looked at another way, the third set of courses are the loosest knit of the component corresponding to the second knuckle of the pinky finger to permit ease of movement. The combination of three stitch sizes within a component permits the creation of high stress zones that permit extra stretch where needed during wearing of the glove. Tension of the yarns is kept relatively constant during stitching. High stress zones are similarly provided in components 512, 514, 516, 518, and 506.

In palm component 504, the stitches vary linearly from along all of the courses of the component from, for example, a value in the range of 25-35 to a value in the range of 15-24. In this way, the palm component 504 becomes more tightly knit as it approaches the wrist component 502.

In wrist component 502, an additional elastic yarn is weft-inserted relative to the main yarn. The wrist component has a constant stitch size with the main yarn for several courses, and then for the next several courses, the yarn is changed to a colored size-indicating yarn 520 having a stitch size smaller than that of the main yarn of the previous several courses. Generally, the colored yarn is a polyester and elastic composite yarn. The wrist component is then finished with an edge formed by a heat fusible yarn 522, which generally comprises elastic, polyester, and low melt polyethylene.

Figure 6:
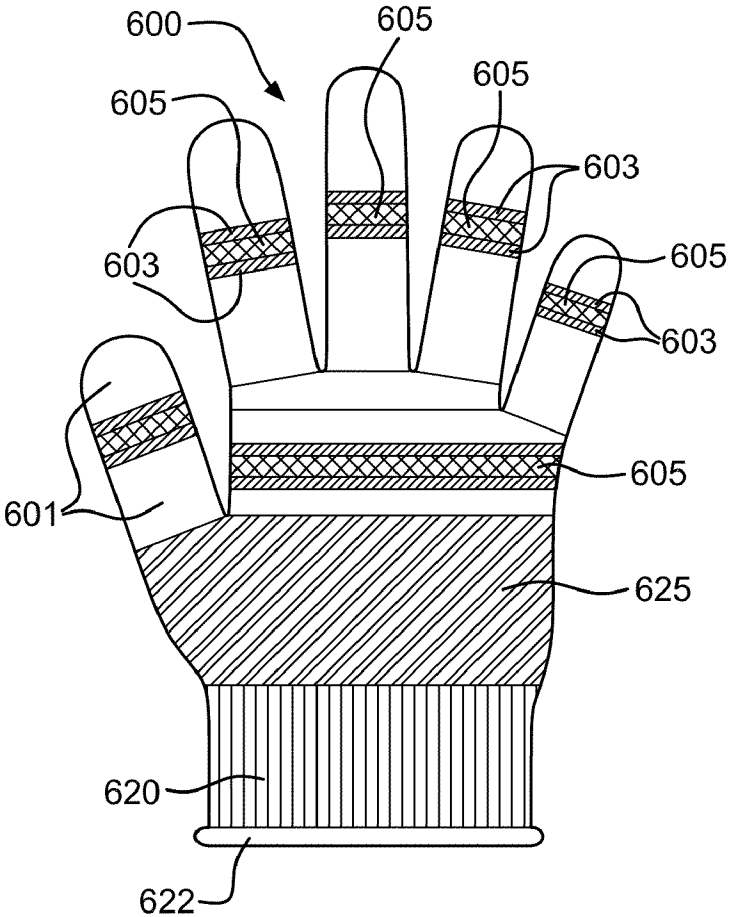
FIG. 6 shows a glove according to an embodiment of the present invention having three different stitch dimensions in the finger components, the thumb component, and one palm component.

Turning to FIG. 6, high stress zones are depicted by the combination of a basic knit 601 with a tight knit 603 and a loose knit 605, where representative such knits are numbered in FIG. 6 and like textures represent like knits. A basic knit refers to the knit size that is in the majority of the glove. Reference to a tight knit means a smaller stitch size relative to the basic knit and a loose knit means a larger stitch size relative to the basic knit. For example, the component in FIG. 6 that corresponds to component 507 of FIG. 5 has a texture of the basic knit. Palm 625 represents linearly varied stitch size.

The wrist 623 is neatly finished with enhanced cuff over-edging 621 which is the result of the colored yarn 520 stitched at a tension suitable to create an outward roll (relative to the finished glove) of the resulting structure. Only a small number of courses (1 or possibly 2, or 3, or 4, or even up to 5) of the heat fusible yarn 522 are needed to prevent unraveling. This unique combination avoids the use of a separate step to provide an overlooking stitch, and thus this combination reduces costs and variability in aesthetics normally associated with the separate overlooking stitch. The enhanced cuff over-edging also prevents loss of stretch that typically results from the use of an overlooking stitch.

The gloves can be knit from different compositions of yarn, including cotton, nylon fibers, water-soluble fibers, such as polyvinyl alcohol, or other fibers that can be used on a knitting machine, such as polyester or high-strength synthetic and/or cut-resistant fibers, such as aramid & para-aramid, polyethylene & ultra high molecular weight polyethylene, and liquid crystal polymer. The yarns used to knit the gloves can be spun yarns, textured filament yarns, or multi-component composite yarns. Gloves according to the present invention are suitable for comfortably handling tools, fine instruments, and small mechanical parts where dexterity is needed.

In some designs, it may be desirable to provide the high stress zones in fewer than all or none of components 510, 512, 514, 516, 518, and 506 in the front side of the glove, which is the side contacting the palm, which in some instances later is coated with an elastomeric polymer. In some embodiments, the high stress zones are provided only on the back (primarily uncoated) side of the glove, which is the side contacting the knuckle.

Figure 7:
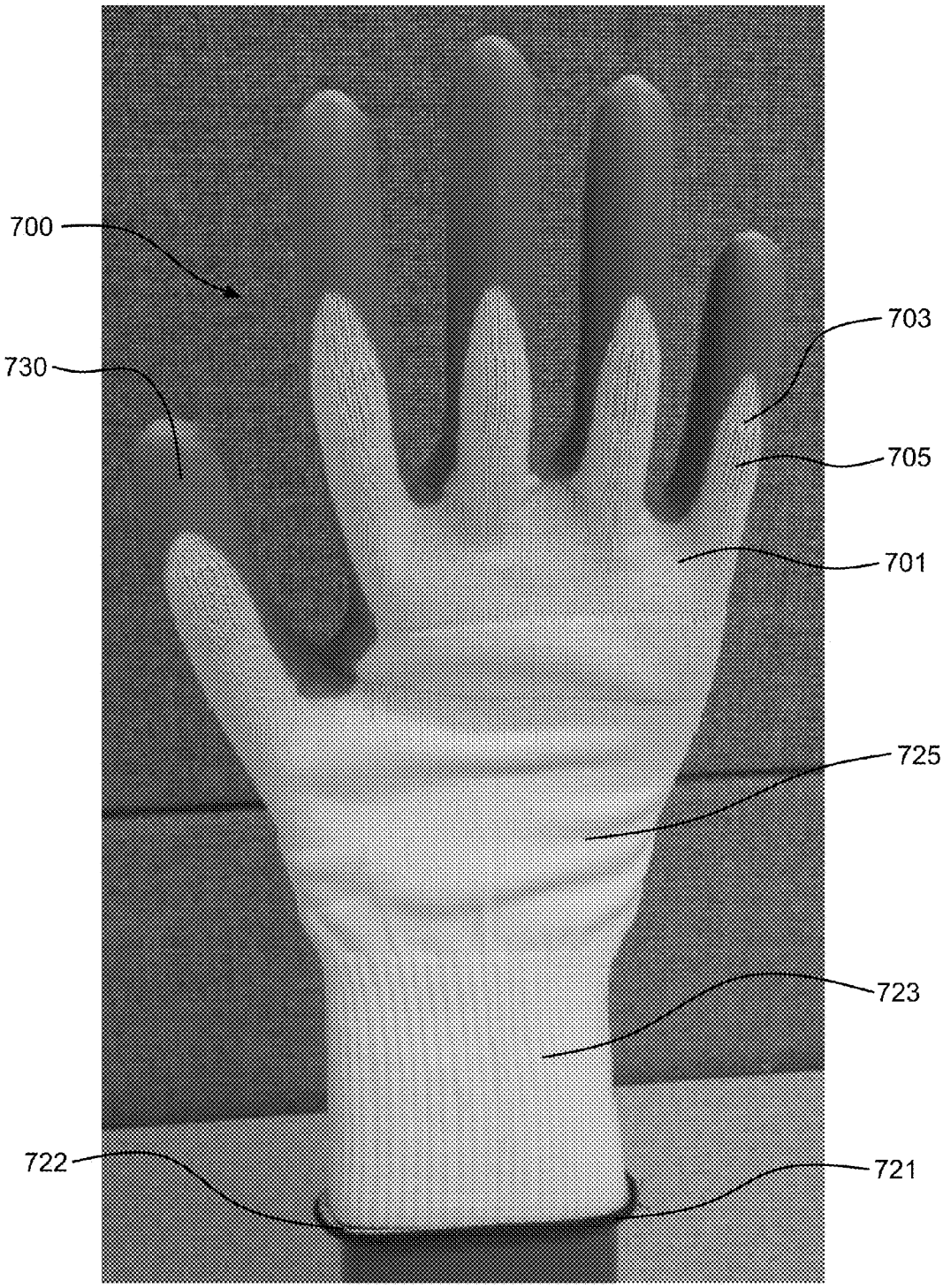
FIG. 7 shows a photograph of a glove according to the FIGS. 5 and 6.

In FIG. 7, a photograph of glove 700 is shown where the high stress zones are in the four finger components, the thumb component, and one of the palm components. A high stress zone is exemplified by the basic knit 701, the tight knit 703, and the loose knit 705. Another of the palm components 725 contains a stitch size that varies throughout the courses of the component. The wrist component 723 contains enhanced cuff over-edging 721 which includes the heat fusible yarn 722. An elastomeric coating 730 is dipped onto the front side of the glove and partial parts of the back side of the finger and thumb components.

Although only a few exemplary embodiments of the present invention have been described in detail above, those skilled in the art will readily appreciate that many modifications are possible in the exemplary embodiments without materially departing from the novel teachings and advantages of this invention. For example, the number of sections of the glove can be increased or decreased to adjust the fit of the glove without departing from the spirit of the present invention. Accordingly, all such modifications are intended to be included within the scope of this invention as defined in the following claims.

The use of the terms "a," "an," "the," and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to illuminate better the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A knitted glove comprising: a body yarn knitted to form:
four finger components;
a thumb component;
a plurality of palm components; and
a wrist component;
wherein at least one of: the four finger components, the thumb component, and one of the palm components each comprises a first plurality of courses having a first stitch dimension, a second plurality of courses having a second stitch dimension, and a third plurality of courses having a third stitch dimension thereby providing high stress zones.

2. The knitted glove of claim 1, wherein each of the four finger components, the thumb component, one of the palm components comprises the first plurality of courses having the first stitch dimension, the second plurality of courses having the second stitch dimension, and the third plurality of courses having the third stitch dimension.

3. The knitted glove of claim 1 comprising three palm components.

4. The knitted glove of claim 3, wherein a first palm component is continuously knitted with three of the four finger components, a second palm component is continuously knitted with the fourth of the four finger components and the first palm component, and a third palm component is continuously knitted with the second palm component and the thumb.

5. The knitted glove of claim 4, wherein the first palm component comprises one stitch dimension, the second palm component comprises three different stitch dimensions thereby providing a high stress zone, and the third palm component comprises three or more different stitch dimensions that are varied linearly.

6. The knitted glove of claim 1, wherein the wrist component comprises a rolled cuff comprising a cuff yarn that is continuously knitted with the body yarn of the wrist component and a heat fusible yarn that is continuously knitted with the cuff yarn.

7. The knitted glove of claim 6, wherein the cuff yarn is colored to provide an indication of size.

8. The knitted glove of claim 1, wherein the body yarn comprises nylon, cotton, a para-aramid, an ultrahigh molecular weight polyethylene, or combinations thereof.

9. The knitted glove of claim 1, further comprising a dipped coating of an elastomeric polymer material on at least the plurality of palm components.

10. The knitted glove of claim 9, wherein the elastomeric polymer material is selected from the group consisting of natural rubber latex and synthetic rubber latex.

11. The knitted glove of claim 9, wherein the body yarn comprises a composite yarn comprising a silicon-free elastic core and at least one wrap of polyester and the elastomeric polymer material comprises nitrile.

12. The knitted glove of claim 1, wherein the high stress zones are provided on a back side of the glove.

13. A method of making a knitted glove from a body yarn, the method comprising:
knitting four finger components;
knitting a thumb component;
knitting a plurality of palm components; and
knitting a wrist component;
wherein at least one of: the four finger components, the thumb component, and one of the palm components each comprises a first plurality of courses having a first stitch dimension, a second plurality of courses having a second stitch dimension, and a third plurality of courses having a third stitch dimension thereby providing high stress zones.

14. The method of claim 13, wherein each of the four finger components, the thumb component, one of the palm components comprises the first plurality of courses having the first stitch dimension, the second plurality of courses having the second stitch dimension, and the third plurality of courses having the third stitch dimension.

15. The method of claim 13, wherein the wrist component further comprises knitting a cuff yarn continuously with the body yarn and a heat fusible yarn continuously with the cuff yarn to form a rolled cuff.

16. The method of claim 13, comprising continuously knitting a first palm component with three of the finger components, a second palm component with the fourth of the finger components and the first palm component, and a third palm component with the second palm component and the thumb.

17. The method of claim 16, wherein the first palm component comprises one stitch dimension, the second palm component comprises three different stitch dimensions thereby providing a high stress zone, and the third palm component comprises three or more different stitch dimensions that are varied linearly.

18. A method of handling tools, instruments, or small parts comprising wearing a glove that comprises high stress zones, wherein the glove comprises a body yarn knitted to form four finger components;

a thumb component;

a plurality of palm components; and a wrist component;

wherein at least one of: the four finger components, the thumb component, and one of the palm components each comprises a first plurality of courses having a first stitch dimension, a second plurality of courses having a second stitch dimension, and a third plurality of courses having a third stitch dimension thereby providing high stress zones.

19. The method glove of claim 18, wherein each of the four finger components, the thumb component, one of the palm components comprises the first plurality of courses having the first stitch dimension, the second plurality of courses having the second stitch dimension, and the third plurality of courses having the third stitch dimension.

20. The method of claim 18, wherein the wrist component comprises a rolled cuff comprising a cuff yarn that is continuously knitted with the body yarn of the wrist component and a heat fusible yarn that is continuously knitted with the cuff yarn.

* * * * *